US007104519B2

(12) United States Patent
O'Maley et al.

(10) Patent No.: US 7,104,519 B2
(45) Date of Patent: Sep. 12, 2006

(54) ADAPTER FOR TOUCH-FREE OPERATION OF GOOSENECK FAUCET

(75) Inventors: James O'Maley, Lighthouse Pt., FL (US); David L. Snodgrass, Stuart, FL (US); Xefu Chen, Greenacres, FL (US); Francis J. Parker, Cooper City, FL (US)

(73) Assignee: Ultraclenz LLC, Riviera Beach, FL (US)

( * ) Notice: Subject to any disclaimer, the term of this patent is extended or adjusted under 35 U.S.C. 154(b) by 0 days.

(21) Appl. No.: 10/796,804

(22) Filed: Mar. 9, 2004

(65) Prior Publication Data

US 2005/0199841 A1 Sep. 15, 2005

(51) Int. Cl.
*F16K 31/02* (2006.01)

(52) U.S. Cl. ..... 251/129.04; 4/623; 4/678

(58) Field of Classification Search ..... 251/129.04; 4/623, 678

See application file for complete search history.

(56) References Cited

U.S. PATENT DOCUMENTS 5,549,273 A * 8/1996 Aharon ..... 251/129.04
6,029,293 A * 2/2000 Paterson et al. ..... 4/623
2005/0082503 A1* 4/2005 Patterson et al. ..... 251/129.04

* cited by examiner

*Primary Examiner*—J. Casimer Jacyna
(74) *Attorney, Agent, or Firm*—Peter J. Phillips; Cooper Dunham LLP

(57) ABSTRACT

An adapter for retrofitting a conventional gooseneck faucet to allow for touch-free activation. The sensor unit of the adapter is attached by simply passing it over the spout of the gooseneck faucet and towards the base of the faucet where it is locked in place by a clamp. Once in place, the sensor unit uses infrared light to sense the proximity of hands under the faucet. When hands are sensed, the control unit mounted under the sink will activate the faucet for as long as hands remain under the faucet.

6 Claims, 2 Drawing Sheets

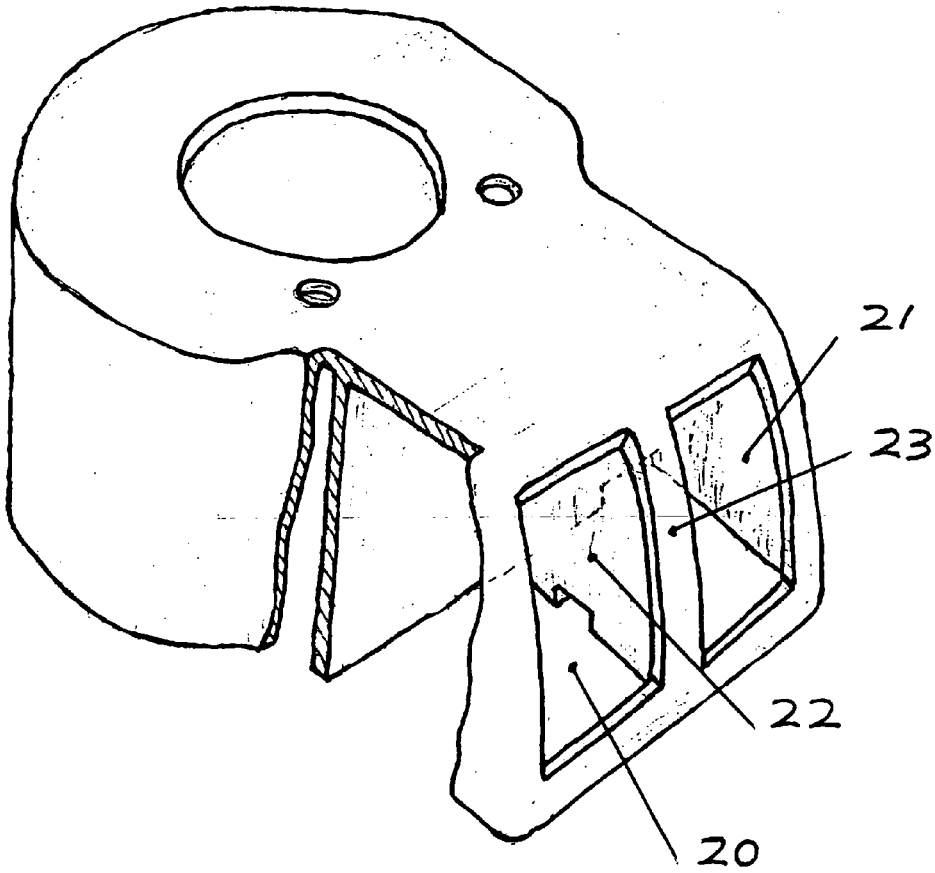
FIG. 2
FIG. 3A
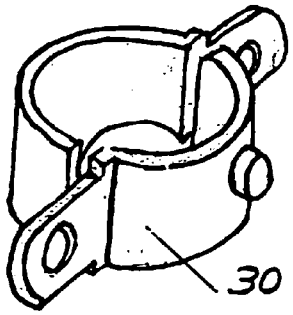
FIG. 3B
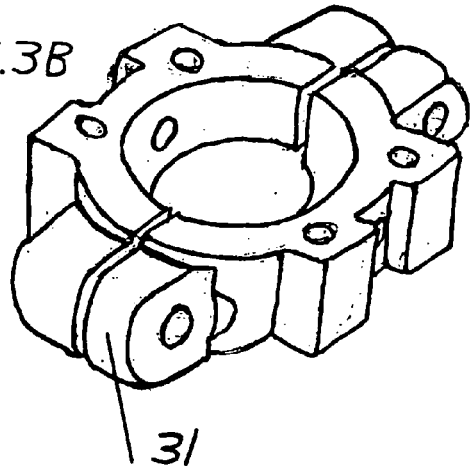

ADAPTER FOR TOUCH-FREE OPERATION OF GOOSENECK FAUCET

FIELD OF THE INVENTION

The present invention relates to the field of sink faucet units and, more particularly, to an apparatus for adapting conventional gooseneck faucets for touch-free operation.

BACKGROUND OF THE INVENTION

In environments such as food handling facilities, there is typically a need for touch-free faucets to improve sanitation. Many such facilities contain a large number of hand washing stations outfitted with sinks using conventional faucets that are activated by hand.

Typically, facilities wishing to adopt touch-free faucets must replace all of their conventional sinks with sinks outfitted with touch-free faucets. Therefore, adoption of touch-free faucets typically comes at great expense to those facilities wishing to upgrade, thereby preventing many such facilities from being able to adopt touch-free faucets and preventing these facilities from improving sanitation. Consequently, there is a need for a way to retrofit sinks having conventional faucets with touch-free faucets.

OBJECTS AND SUMMARY OF THE INVENTION

It is an object of the current invention to solve the problem discussed above relating to previously known touch-free faucets.

Specifically, it is an object of the current invention to provide a touch-free faucet that can be adapted to conventional sinks without the need of replacing the entire sink.

It is also an object of the current invention to provide a hand sensing system that is less likely to produce a false activation.

It is also an object of the current invention to provide a hand washing system that will not lock in the "on" position allowing water to flow under conditions of a power outage.

It is also an object of the current invention to provide a hand washing system that is microprocessor controlled and capable of collecting and utilizing operational data to provide additional features.

The current invention allows users to retrofit existing conventional sinks with touch-free faucets.

One embodiment of the present invention relates to a touch-free faucet adapter for converting a conventional gooseneck faucet to a touch-free faucet, comprising: a sensor unit serving as an infrared proximity detector that can be attached to a variety of gooseneck faucet types and sizes for sensing the presence of hands under the faucet; and a controller unit mounting below the sink for responding to signals sent from the sensor unit, wherein the controller unit is operating valves to turn water on in response to a hand present under the faucet and turn water off after hand is withdrawn; wherein, the sensor unit accommodates gooseneck faucets of a plurality of varying shapes and sizes. The sensor unit comprising: two infrared (IR) LEDs that are relatively narrow beam types and an integrated circuit photo detector element; wherein one IR LED is pointed up and the other IR LED is pointed slightly downwards, thereby ensuring a very wide vertical range of detection from below the sensor unit up to an upper limit somewhere under the spout opening, thereby preventing water from spraying outward from a hand placed too close to the spout opening while avoiding the problem of users having to "search" for detection when they place their hands beyond the range of detection, with the downwards pointing LED additionally preventing false activation by specular reflection from the edge of the sink, a common problem for systems in which the LEDs are horizontally oriented directly outward; wherein the upper range limit is adjusted by controlling the current through the LED pointing upwards and the lower range limit is adjusted by controlling the current through the LED pointing downwards; wherein the LEDs are both inclined vertically with respect to the water column formed with the water running thereby avoiding direct reflection of the IR light from the flowing water, and wherein the LEDs are both horizontally directed a few degrees away from the water column thereby further avoiding direct reflection of the IR light from the flowing water; the sensor unit further comprising a housing with internal barriers for preventing the transmission of light directly from the LED to the photo sensor and a window capable of passing only IR light is used to keep ambient light out of the photo sensor wherein the housing is molded with a slightly protruding barrier or ridges that serves to separate the LED window and the photo sensor window to prevent splashed water droplets from forming a light conducting bridge from the LED to the photo sensor, wherein the sensor unit is mechanically designed to attach by simply passing the sensor housing over the spout end and towards the base of the faucet where it is held in place by two semi-cylindrical clamping parts adjusted by two screws with two semi-cylindrical rubber parts placed between the clamp parts and the metal spout to permit adjustment of the clamp to compensate for variations of faucet diameters and to provide friction to lock the sensor in place on the spout. The controller unit comprising two latching solenoid valves, one controlling the hot water source and the other controlling the cold water source, two manual valves to initially set the temperature of the water discharged from the faucet, a controller circuit to provide a 1.5 second turnoff delay and sensor hysteresis to prevent chattering (on-off pulsing) as hands move about when rinsing, and a circuit to automatically pulse the faucet to the off state upon power failure, a short term power storage capacitor to provide power for the shutoff, and an associated circuit.

Another embodiment of the present invention also relates to a touch-free faucet adapter for adapting a conventional sink with a touch-free faucet. Here, however, this embodiment allows for adapting a sink with a faucet type other than gooseneck. Here the sensor unit is mounted directly on the sink near the faucet.

Another embodiment of the present invention also relates to a touch-free faucet adapter for adapting a conventional sink with a touch-free faucet. Here, however, the temperature of discharging water is maintained by including two servo-type valves in the controller unit, one to control hot water and the other to control cold water, wherein a temperature sensing element is mounted in the sensor unit in contact with the faucet to read the temperature of the water with temperature information being used by the control circuit to control the servo-type valves and regulate the temperature of the water, with this embodiment only requiring a single solenoid rather than two.

Another embodiment of the present invention also relates to a touch-free faucet adapter for adapting a conventional sink with a touch-free faucet. Here, however, the controller unit further contains a microprocessor that will permit: cumulative measurement of the time during which the faucet allows water to flow to allow for calculation of water displacement to monitor conservation of water, storing of programmed LED range settings, automatic range setting, automatic test sequence for field servicing of the unit, turning on the hot water before turning on the cold water to lessen the time it takes to reach the desired temperature to be used along with an antiscald device, and application of various other operational parameters to be programmed for example a time limit on the run-time of each activation to conserve water.

Another embodiment of the present invention further contains a microprocessor that will permit inhibiting the controller unit from activating the flow of water though the faucet when such a command has been input.

Another embodiment of the present invention further contains a microprocessor that will display a signal indicating that the flow of water through the faucet has been activated when the flow of water through the faucet has been activated.

BRIEF DESCRIPTION OF THE DRAWINGS

FIG. 2 shows a sensor unit housing for use in the first embodiment of the current invention; and FIG. 3 shows a rubber part and a clamp for use in the first embodiment of the current invention.

DETAILED DESCRIPTION OF THE DRAWINGS

Figure 1A:
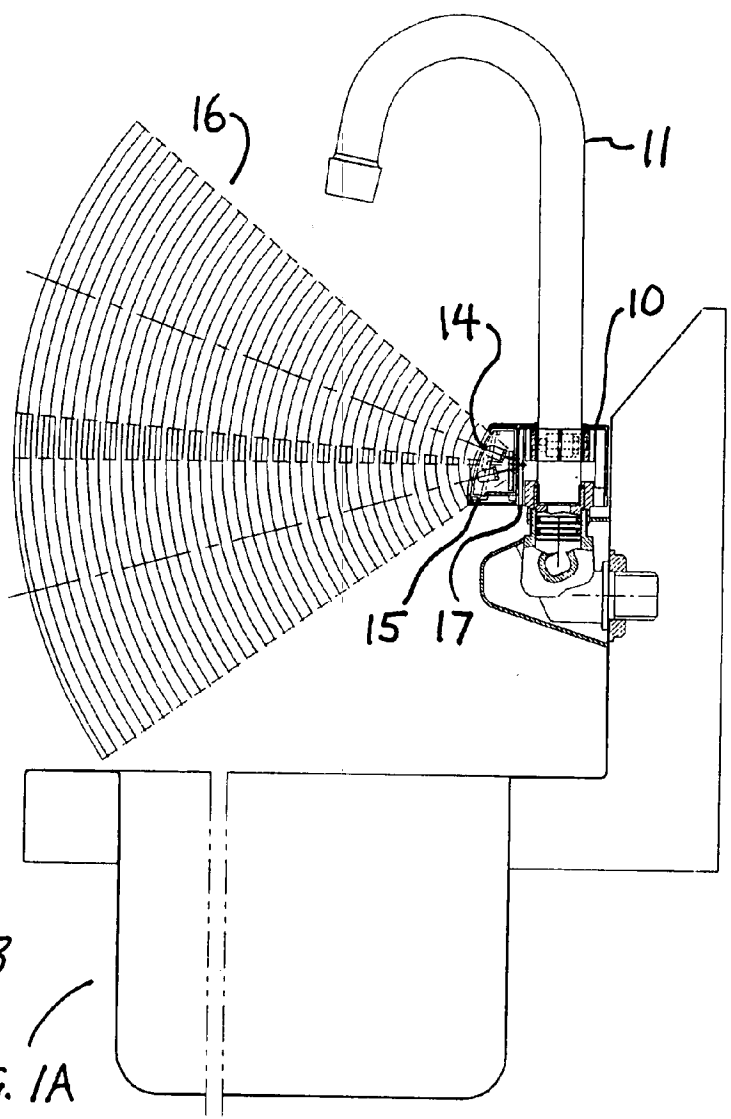
FIGS. 1A and 1B show a first embodiment of the touch-free faucet according to the present invention.
Figure 1B:
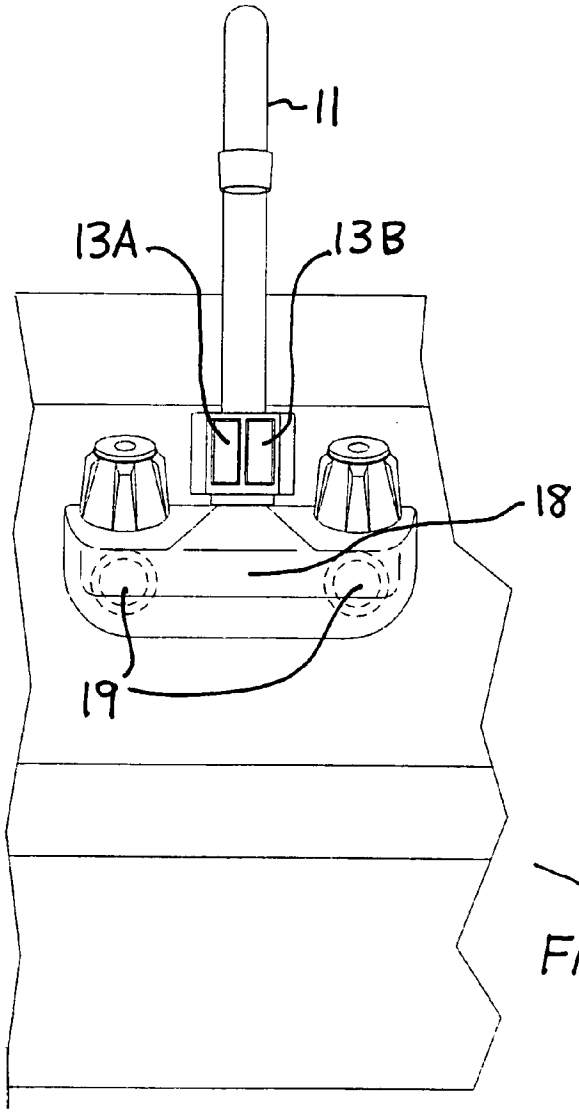

Referring to FIGS. 1A and 1B, a first embodiment of a touch-free faucet according to the present invention is shown. FIG. 1 shows a sensor unit 10, serving as an infrared (IR) proximity detector, that has been inserted around a gooseneck faucet 11 and held in place by tightening a clamp 12. The sensor unit incorporates a transmitter window 13*a* and a receiver window 13*b*, both windows are transparent to IR light but otherwise opaque, behind which a first IR LED 14 and a second IR LED 15 are positioned, wherein both IR LEDs produce relatively narrow IR beams, the first IR LED 14 is oriented to point up while the second IR LED is oriented to point slightly down thereby producing a wide vertical range of detection 16; wherein when a hand is placed within the range of detection, reflected IR light is detected by an integrated circuit photo detector element 17 that generates a signal that is sent to a controller unit 18 mounted below the sink, wherein the controller unit, upon receiving the signal, activates two latching solenoid valves 19, one controlling a hot water source and the other controlling a cold water source, wherein when said signal is received by the latching solenoids, water is allowed to flow out the faucet until hands are pulled out of the range of detection 16 thereby ending signal generation from the photo detector element and the latching solenoids are allowed to close stopping the flow of water from the faucet.

FIG. 2 shows a sensor unit housing for use in the first embodiment of the current invention. The sensor unit housing incorporates: a transmitter window 20 and a receiver window 21, wherein both windows are transparent to IR light but otherwise opaque; an internal barrier 22 for preventing the transmission of IR light directly from the LEDs to the photo sensor, and a ridge 23 that serves to separate the transmitter window 20 from the receiver window 21 to prevent splashed water droplets from forming a light conducting bridge from the LED to the photo sensor.

FIG. 3 shows a rubber part 30 and a clamp 31 for use in the first embodiment of the current invention, wherein the clamp 31 incorporates two semi-cylindrical clamping parts, wherein after the sensor unit is slipped over and down the gooseneck faucet, the sensor unit is locked in place by screwing together the two semi-cylindrical clamping parts around the faucet wherein the rubber part 30 incorporating two semi-cylindrical rubber part halves, is placed between the clamp 31 and the faucet to permit adjustments to the clamp to compensate for variations of faucet diameters and to provide friction to lock the sensor in place on the faucet.

The invention claimed is:

1. A touch-free adapter apparatus for retrofitting a sink with a conventional touch-activated faucet, comprising:

a sensor unit: and a controller unit, wherein said sensor unit is attached to said sink to detect the proximity of a user's hands and when said hands are detected said sensor unit sends a signal to said controller unit to activate the flow of water though the faucet, wherein said sensor unit comprises:

a first infrared (IR) LED that is oriented to point up relative to the horizontal:

a second IR LED that is oriented to point down relative to the horizontal: and a photo detector element, wherein a wide vertical range of detection results spanning from below said sensor unit up to an upper limit located below a spout of said faucet, thereby preventing activation by a hand placed too close to said spout while allowing for wide range of detection and preventing specular reflection from an edge of said sink, and wherein said sensor unit comprises:

a transmitter window located in front of said first and second IR LEDs that is transparent to IR light but is opaque to ambient light:

a receiver window located in front of said photo detector element that is transparent to IR light but opaque to ambient light:

an internal barrier for preventing the transmission of light directly from said first and second IR LEDs to said photo detector element: and a sensor unit housing molded with one or more slightly protruding barriers or ridges that serve to separate said transmitter window from said receiver window for preventing splashed water droplets from forming a light conducting bridge from said first or second IR LEDs to said photo detector element.

2. The touch-free faucet adapter apparatus as set forth in claim 1, wherein said sink with a conventional touch-activated faucet contains a faucet that is a gooseneck style faucet, and said sensor unit is mechanically attached to the faucet by passing the sensor unit over a spout end of the faucet and towards a base of the faucet where it is locked in a place by a clamping part.

3. The touch-free adapter apparatus as set forth in claim 1, wherein said sensor unit comprise:

a first infrared (IR) LED that is oriented to point up relative to the horizontal:

a second IR LED that is oriented to point down relative to the horizontal: and a photo detector element, wherein a wide vertical range of detection results spanning from below said sensor unit up to an upper limit located below a spout of said faucet, thereby preventing activation by a hand placed too close to said spout while allowing for wide range of detection and preventing specular reflection from an edge of said sink.

4. A touch-free faucet adapter apparatus for retrofitting a sink with a conventional touch-activated faucet, comprising:

a sensor unit: and a controller unit, wherein said sensor unit is attached to said sink to detect the proximity of a user's hands and when said hands are detected said sensor unit sends a signal to said controller unit to activate the flow of water though the faucet, wherein said controller unit comprises:

a first latching solenoid valve for activating and deactivating a hot water source:

a second latching solenoid valve for activating and deactivating a cold water source:

a first manual valve for adjusting a flux of hot water: and a second manual valve for adjusting a flux of cold water, wherein said first and second manual valves are used to initially set a desired mix or hot and cold water and said first and second latching solenoid valves are used to activate and deactivate the flow of said water:

wherein a controller circuit automatically pulses said faucet to an off state upon power failure and said controller unit further includes a short term power storage capacitor to provide power for the shutoff: and wherein said controller circuit additionally provides a 1.5 second delay and sensor hysteresis to prevent the water from pulsing on and off in response to the movement of hands in and out of range of detection of said sensor unit.

5. The touch-free faucet adapter apparatus as set forth in claim 4, wherein said sink with a conventional touch-activated faucet contains a faucet that is a gooseneck style faucet, and said sensor unit is mechanically attached to the faucet by passing the sensor unit over a spout end of the faucet and towards a base of the faucet where it is locked in a place by a clamping part.

6. The touch-free adapter apparatus as set forth in claim 4, wherein said sensor unit comprises:

a first infrared (IR) LED that is oriented to point up relative to the horizontal:

a second IR LED that is oriented to point down relative to the horizontal: and a photo detector element, wherein a wide vertical range of detection results spanning from below said sensor unit up to an upper limit located below a spout of said faucet, thereby preventing activation by a hand placed too close to said spout while allowing for wide range of detection and preventing specular reflection from an edge of said sink.

* * * * *